United States Patent [19]

Preston

[11] Patent Number: 4,567,810

[45] Date of Patent: Feb. 4, 1986

[54] AUTOMATIC FIREARM

[75] Inventor: A. Edward Preston, Hialeah, Fla.

[73] Assignee: Wildfire Munitions, Inc., Hialeah, Fla.

[21] Appl. No.: 588,993

[22] Filed: Mar. 13, 1984

[51] Int. Cl.[4] ..... F41C 5/06; F41D 11/02

[52] U.S. Cl. ..... 89/142; 89/143; 89/196

[58] Field of Search ..... 89/194, 195, 196, 139, 89/140, 142, 143, 148

[56] References Cited

U.S. PATENT DOCUMENTS

| | | | |
|---|---|---|---|
| 2,376,057 | 5/1945 | Hyde | 89/148 |
| 2,385,057 | 9/1945 | Browning | 89/141 |
| 2,539,554 | 1/1951 | Sampson et al. | 89/194 X |
| 2,807,196 | 9/1957 | Saetter-Lassen | 89/142 |
| 2,935,000 | 5/1960 | Mowry | 89/196 X |
| 3,290,993 | 12/1966 | Irusta | 89/140 |
| 4,335,643 | 6/1982 | Gal | 89/196 |
| 4,421,009 | 12/1983 | Castellano et al. | 89/140 |
| 4,523,510 | 6/1985 | Wilhelm | 89/142 X |

FOREIGN PATENT DOCUMENTS

| | | | |
|---|---|---|---|
| 659122 | 2/1965 | Belgium | 89/140 |
| 1052274 | 3/1959 | Fed. Rep. of Germany | 89/142 |

*Primary Examiner*—David H. Brown

*Attorney, Agent, or Firm*—LeBlanc, Nolan, Shur & Nies

[57] ABSTRACT

A firearm in the form of a submachine gun which can fire in either a semiautomatic or full automatic mode. The firearm is provided with a front sear, a front trigger and a rear sear/trigger in a construction which allows the operator to instantly change between the semi and fully automatic mode without a selector switch, even while firing. Other features include capability for ambidextrous operation, the use of two magazines each located in a separate handgrip and an improved muzzle brake configuration. In addition, an improved ejector and magazine catch assembly are provided. The firearm of the present invention employs fewer moving parts so as to require no pins or screws for the trigger, sear, bolt guide or bolt stop.

10 Claims, 11 Drawing Figures

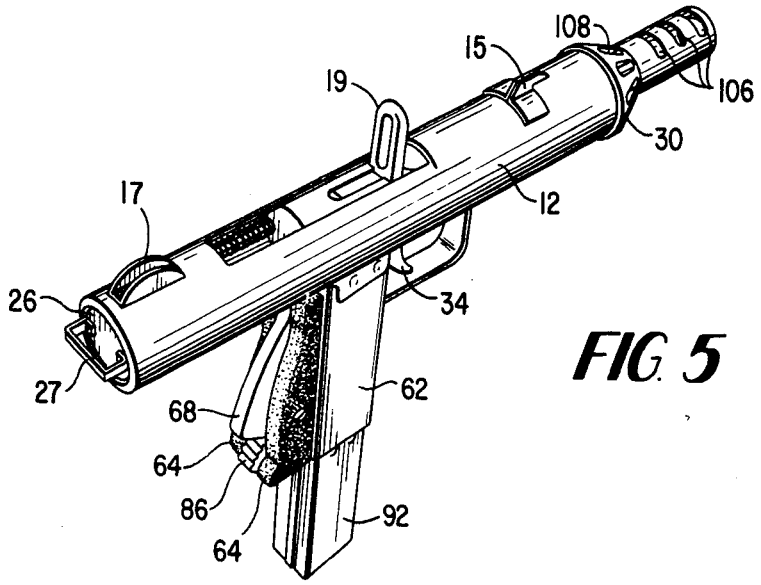
FIG. 5
FIG. 6
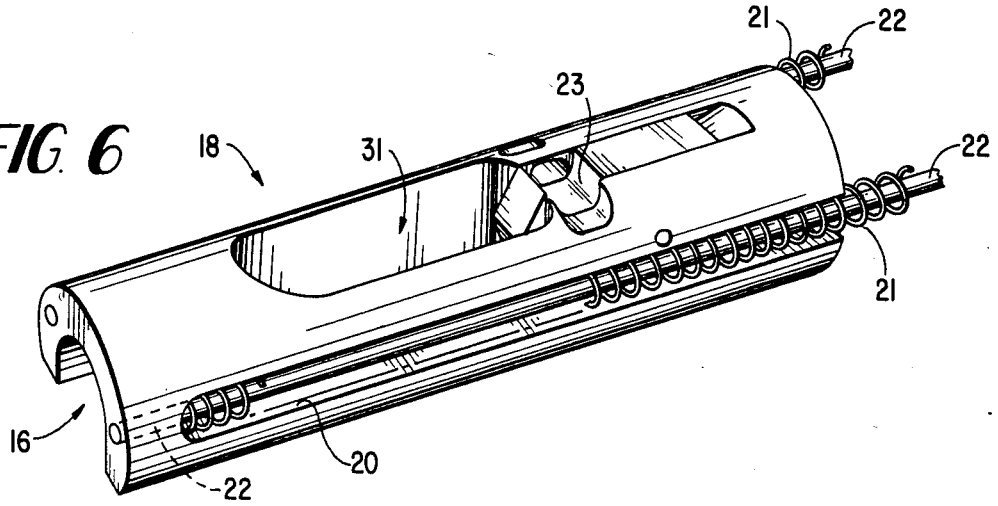
FIG. 7
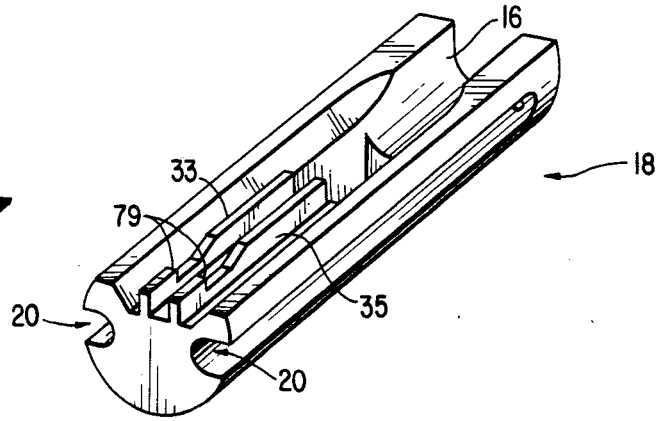

FIG. 8
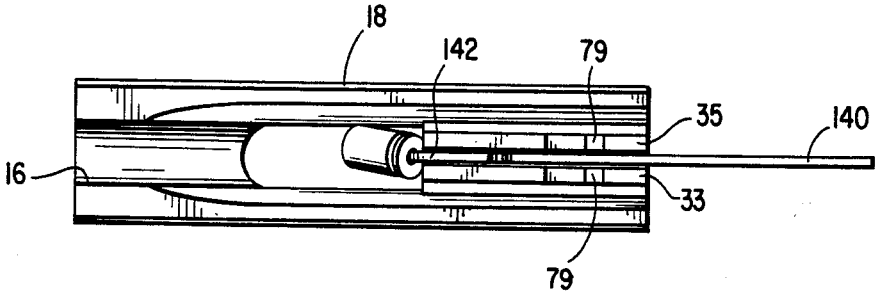
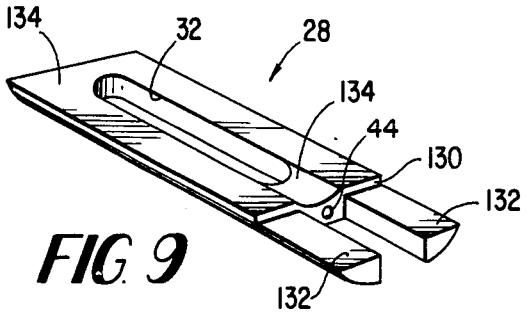
FIG. 9
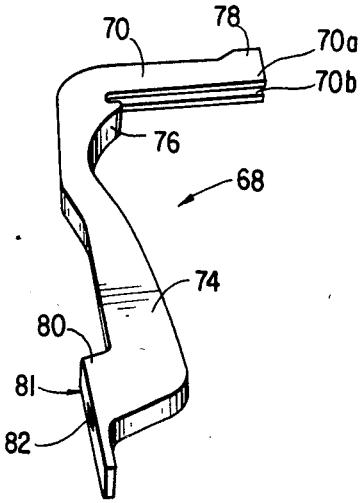
FIG. 10
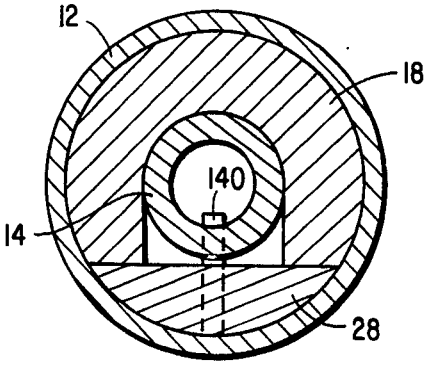
FIG. 11

AUTOMATIC FIREARM

BACKGROUND AND SUMMARY OF THE INVENTION

The present invention relates to a firearm which may be used in either the automatic or semiautomatic mode. More particularly, the present invention relates to a submachine gun which is capable of being fired in either automatic or semiautomatic operation and having features which are well suited to meet current specialized defense needs.

In the field of automatic and semiautomatic weapons for use by law enforcement agencies such as Special Weapons and Tactics (SWAT) units as well as the modern day soldier, there has been a need for a weapon which has a fast reaction time and is also ultra light and easily controllable. The close ranges which are frequently encountered today in both the urban and jungle environments have reduced the available reaction time so much that conventional systems for switching between automatic and semiautomatic fire are not adequate. Thus there has arisen a need for a compact and rugged automatic submachine gun having features which are well suited for close combat while also providing the mobility and lightweight freedom of a conventional sidearm.

Previous automatic and semiautomatic firearms have been described in the following U.S. Pat. Nos: 2,385,057 to Browning; 2,931,120 to Kilin; 3,290,993 to Irusta; 3,964,368 to Safie; 4,057,003 to Atchisson; and 4,421,009 to Castellano et al.

By the present invention, there is provided an improved automatic firearm having features which include instinctive fire control, a system employing a unique arrangement of front sear and trigger with a rear sear/trigger to allow the operator to instantly change between the semiautomatic and fully automatic mode without a selector switch, even while firing.

The automatic firearm of the present invention is totally ambidextrous. Thus a right or left handed user has complete access to all of the weapon operating controls. This feature has been achieved by placing the charging handle and both magazine catches on the longitudinal center axis and constructing the front hand grip to rotate up to 90° in either direction. Such a construction also provides a more comfortable foregrip and permits the weapon to be fired blind behind a right or left hand corner while maintaining positive control. Also, in less than one minute, the front hand grip can be removed without tools, transforming the firearm into a semi or fully automatic pistol which is easily concealed for executive or dignitary protection.

The automatic firearm of the present invention, employing a unique merger of fewer moving parts, requires no pins or screws for the trigger, sear, bolt guide or bolt stop, thus resulting in fewer operational problems. Due to the particular construction of the present firearm, even if the front sear, front trigger and charging handle were all to be damaged so as to require removal, it would still be possible to fire the weapon, fully controlled, in the fully automatic mode, with the operator using a finger to charge the bolt, after which firing is accomplished with the rear trigger. In addition, the barrel, barrel nut and muzzle brake are provided in the form of an integral one-piece assembly that allows instant barrel replacement. Thus the entire weapon can be field stripped in a short period of time without the use of tools.

The firearm of the present invention is provided with dual magazines, with the active magazine feedway entrance being located in the rear handgrip which provides firm support for the magazine. A second magazine is stored in the front handgrip, allowing rapid magazine exchanges, especially at night, using the principle of "hand finds hand". In one embodiment, each magazine contains 32 rounds, thus providing an unprecedented amount of ammunition within the weapon. The magazines can be loaded by hand without the inconvenience of a loading tool.

The futuristic appearance of the present firearm is the result of specific construction features which provide functional superiority. Thus the tubular receiver, flush sides, rounded upper body and built-in heat sinks of the firearm all contribute to improved operation. In addition, the smooth sleek construction of the present firearm results in no protruding parts which can snag fabric or vegetation. The short overall length of the firearm was obtained by telescoping the bolt around the barrel. The light weight of the firearm, which in one embodiment is only 4.3 pounds without magazines, makes it one of the lightest weapons of its class. Also, in one embodiment, the present firearm produces a muzzle velocity of 1280 fps (390 mps) using 9 mm parabellum ammunition firing at a rate of 750 rpm. As a further feature, the front sear of the present firearm is stronger than any known in use today.

By the present invention, there is provided a versatile weapon which is light weight, capable of holding a large amount of ammunition, and with features including instinctive fire control and a trouble free loading system which result in a weapon having superior capabilities as a counterterrorist, counterguerilla, urban operations weapon for military or police use.

BRIEF DESCRIPTION OF THE DRAWINGS

FIG. 5 is a perspective view of an alternative embodiment of the present invention.

FIG. 6 is a top perspective view of the bolt member employed in the present invention.

FIG. 7 is a bottom perspective view of the bolt member of FIG. 6.

FIG. 8 is a bottom plan view of the bolt member of FIG. 6 shown with the ejector.

FIG. 9 is a perspective view of the front sear employed in the present invention.

FIG. 10 is a perspective view of the rear sear/trigger employed in the present invention.

FIG. 11 is a cross-sectional view taken along line 11—11 of FIG. 3.

DESCRIPTION OF THE PREFERRED EMBODIMENTS

Figure 1:
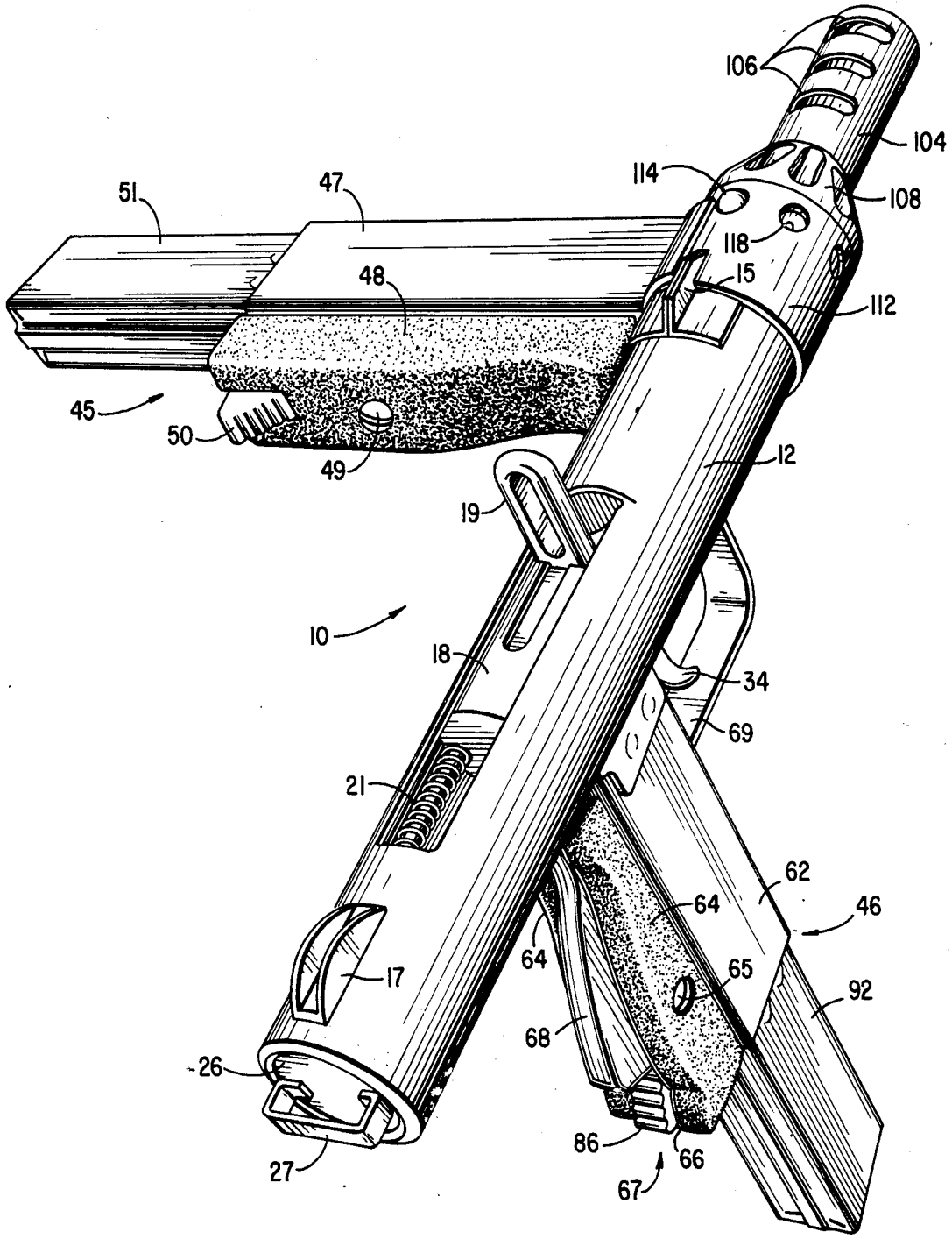
FIG. 1 is a perspective view of the firearm of the present invention, showing the front handgrip rotated 90 degrees to the left.

In the embodiments of the invention as shown in FIGS. 1 through 11, there is provided a firearm in the form of a submachine gun 10 having a receiver 12 of generally tubular shape which houses a coaxially mounted reciprocating bolt member 18 having a central bore 16 in the forward portion for receiving the barrel 14 in telescoping sliding relation. A front 15 and a rear 17 sight are mounted on the centerline of the receiver 12, the front sight 15 being in the form of a fixed shielded post and the rear sight 17 being a fixed open sight in one embodiment of the invention.

The bolt member 18 has a pair of channels 20 extending parallel to the longitudinal axis of the bolt 18, one channel 20 on either side of the bolt 18, for use in receiving a respective recoil spring 21 coaxially mounted on a spring rod 22 which extends substantially the length of the bolt 18 and to the rear thereof for attachment to a recoil spring back plate 24, as shown in detail in FIGS. 2–4 and 6. The forward end of each spring rod 22 may be slidably secured to the bolt 18 by crimping the front of the rod 22. Thus when the bolt 18 is in the closed bolt position, the front ends of the rods 22 will be flush with the front face of the bolt 18, as shown in FIG. 6. As the bolt 18 moves rearwardly of this position to the open bolt position, the rods 22 will be exposed forward of the front face of the bolt 18. The plate 24 abuts against the back tube plate 26 which fits within the crimped end of the tubular receiver 12 to form the back wall of the receiver 12. A sling holder 27 in the form of a U-shaped bar is secured to the exterior of plate 26. A sling assembly may be attached to the holder 27 to provide stability during firing as well as a means of carrying the weapon.

Figure 2:
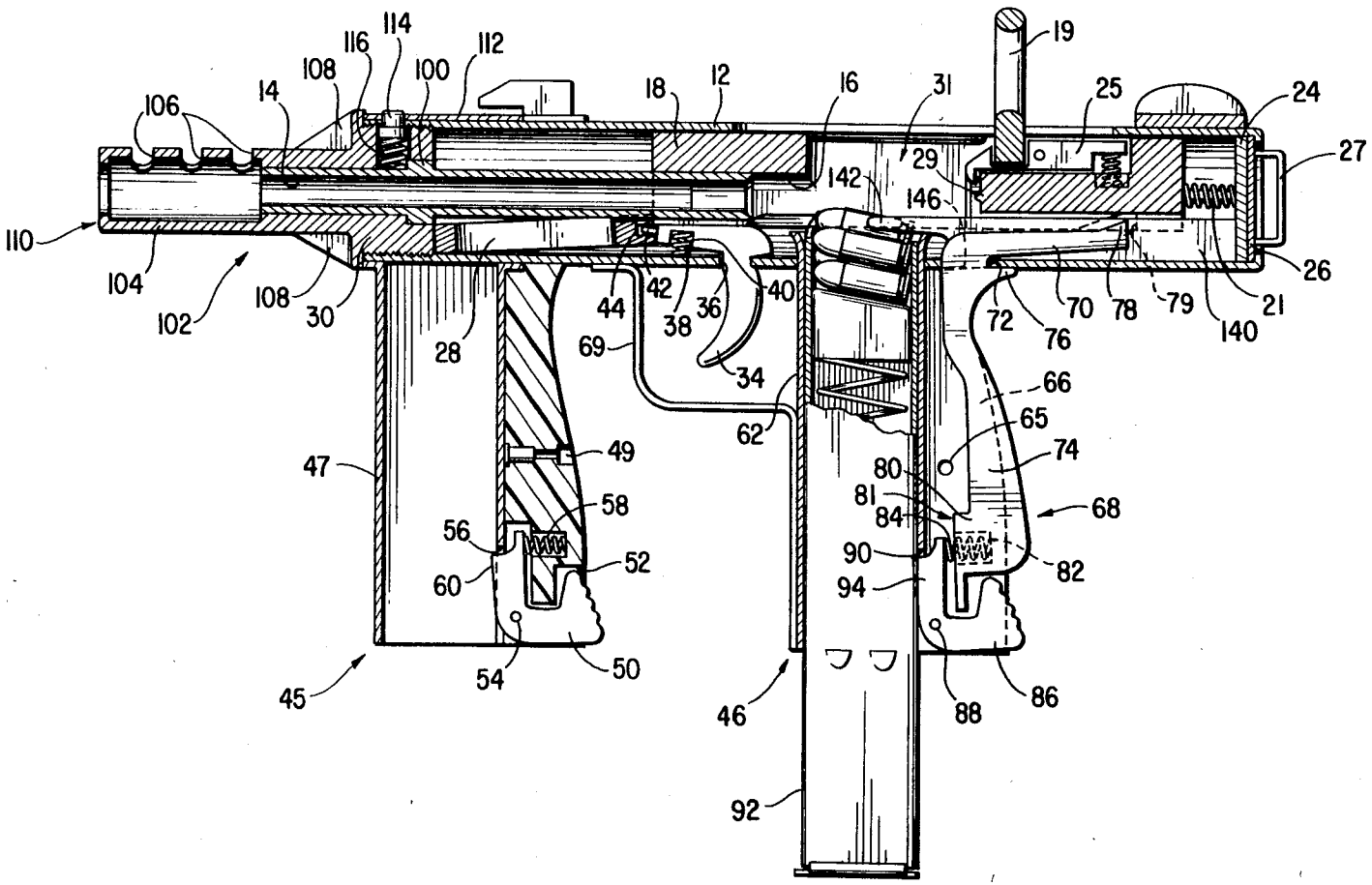
FIG. 2 is a side elevation, in partial cross section, showing the firearm of the present invention in a first position during operation of the firearm.
Figure 3:
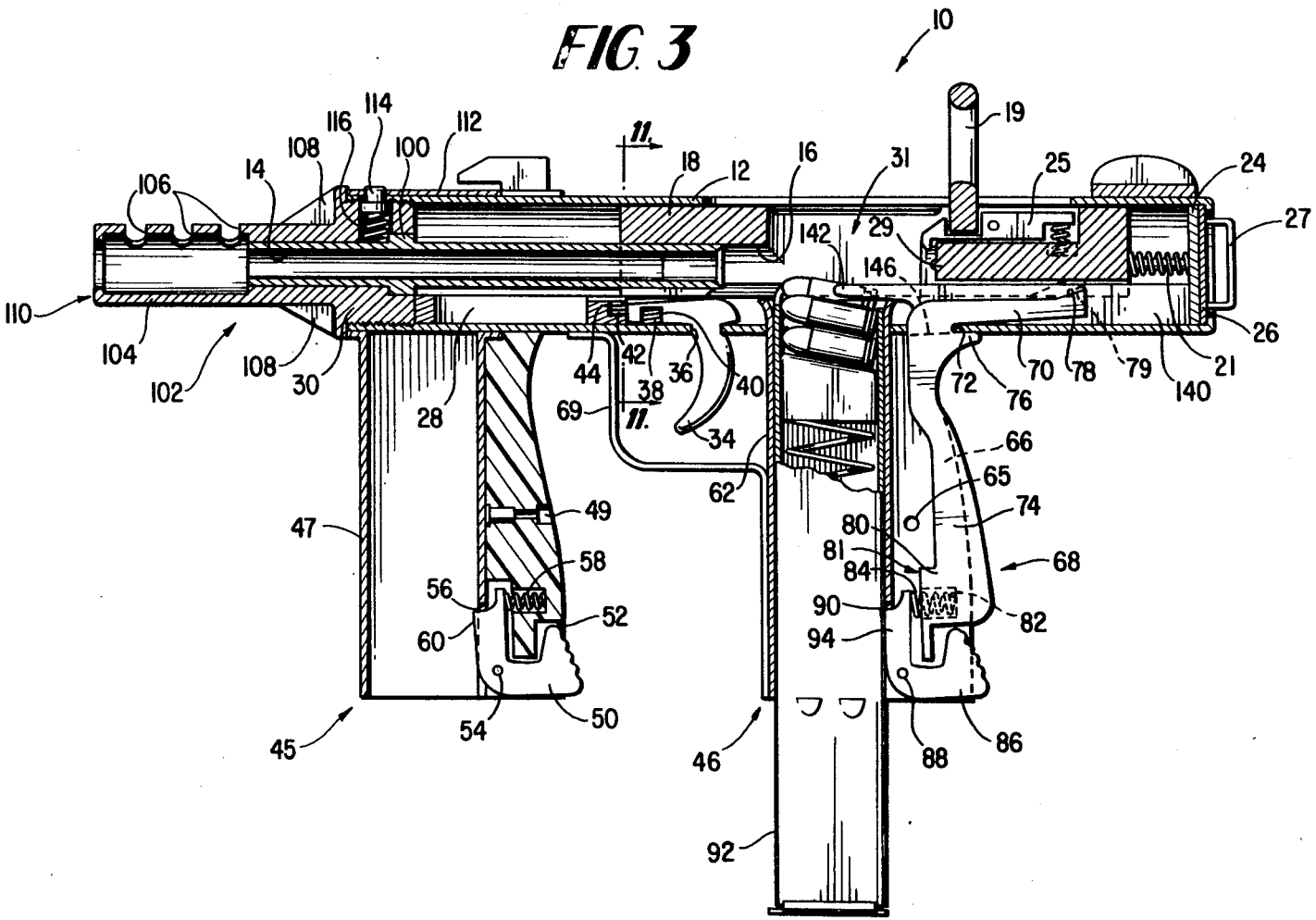
FIG. 3 is a partial side elevation, similar to FIG. 1, showing the firearm in a second position during operation.
Figure 4:
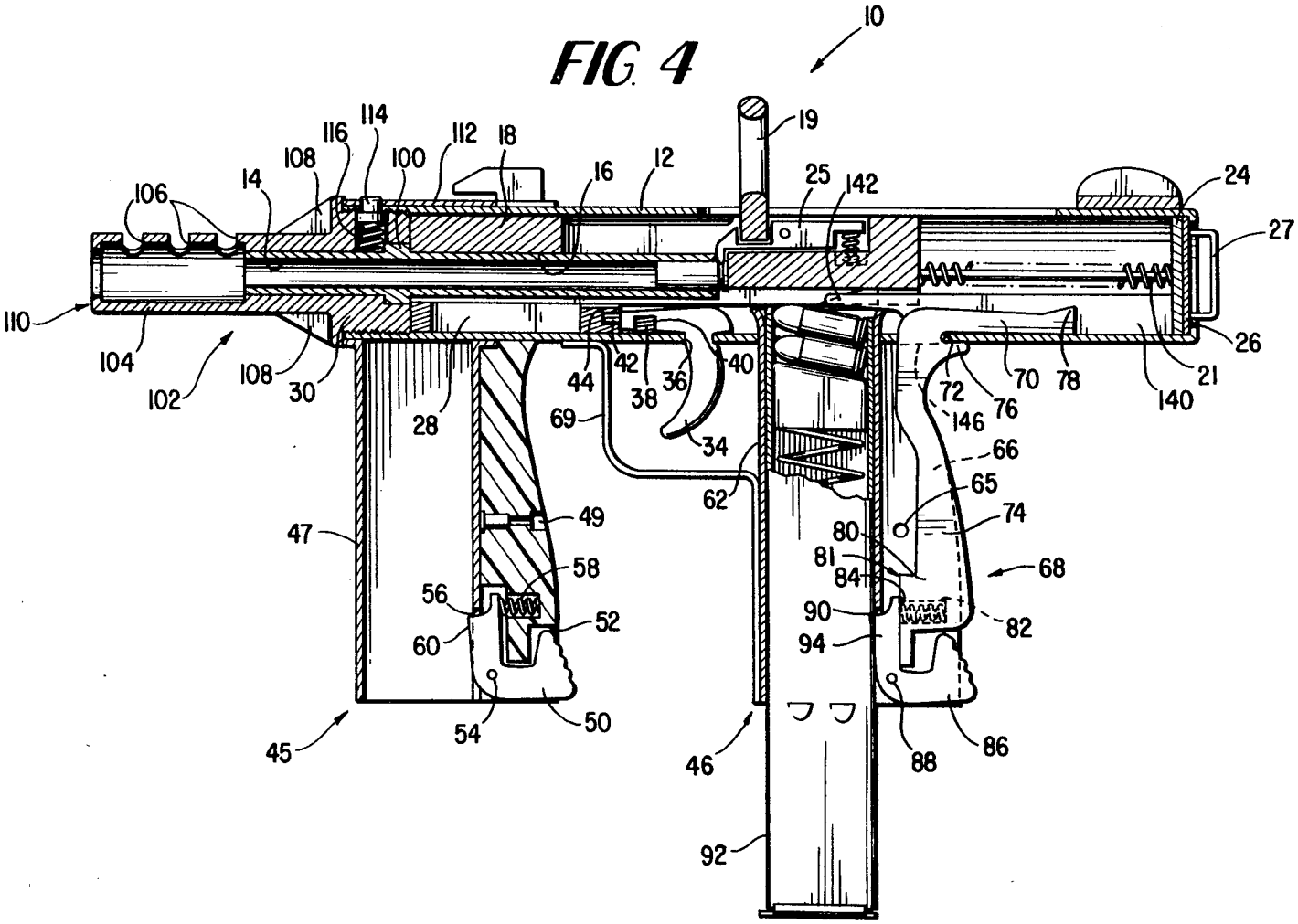
FIG. 4 is a partial side elevation, similar to FIG. 1, showing the firearm in a third position during operation.

The bolt member 18 is provided with a bolt charging handle 19 which is mounted in recess 23 and centered on the longitudinal axis of the bolt 18. As shown in FIGS. 2–4, the bolt 18 has a spring mounted extractor 25 and a fixed firing pin 29 of conventional construction mounted therein. An opening 31 in the bolt 18 allows for loading and ejection of ammunition. On the underside of the rear portion of the bolt 18, as shown in FIGS. 7 and 8, there are located a pair of parallel ribs 33, 35 positioned equidistant from the vertical plane through the longitudinal axis of the bolt 18. Each rib 33, 35 is provided with a notched portion 79 which engages the rear sear/trigger in one position of the bolt 18 as described hereinafter.

Located within the receiver 12 and below the barrel 14 is the main/front sear 28, shown in detail in FIG. 9, which abuts at its forward end against the barrel locking nut 30, to be described in detail hereinafter. As shown in FIG. 11, the front sear 28 cooperates with the bolt 18 to completely encircle the barrel 14 when the bolt 18 overlies the sear 28. The front sear 28 is of a generally flat configuration, in the general shape of a portion of a cylinder, having a central opening 32 of elliptical shape and with a recess 44 located in the center portion of the rear vertical surface 130 of the sear 28 for receiving a portion of the front trigger 34. In the embodiment as shown in FIG. 11, the sear 28 would be formed by extending a horizontal plane through a cylinder having a radius equal to that of the bolt 18, at a level approximately $\frac{1}{2}$ radius above the bottom of the cylinder. The sear 28 has a pair of projections or ears 132 extending rearwardly on either side of the recess 44, for use in maintaining the alignment between sear 28 and trigger 34. The ears 132 are stepped down below the upper surface 134 of the main portion of the sear 28 to allow the rear surface 130 of the sear 28 to engage the front end of the bolt 18 when the bolt 18 is in the fully open position as shown in FIG. 2. The opening 32 helps to reduce the weight of the sear 28 and is located adjacent a trough portion 134 which allows free movement of the sear 28 relative to the barrel 14.

The front trigger 34 is positioned within the receiver housing 12 as shown in FIGS. 1–4, with the lower portion extending through an opening 36 in the receiver 12 so as to be operable by pressing the lower portion on the exterior of the receiver 12. A spring 38 is positioned vertically within a recess 40 in the forward end of the trigger 34. In the closed bolt position as shown in FIG. 4, the spring 38 bears upwardly from its lower end engagement with the lower wall of the housing 12, thus biasing the rear end of the sear 28 upwardly, due to the action of forward trigger lug 42 against the upper surface of the recess 44 in the sear 28. Thus as the bolt 18 is moved to the rear during operation of the firearm 10, the action of the spring 38 causes the rear portion of the sear 28 to move upwardly and, as the front end of the bolt 18 passes the rear end of the sear 28, the sear 28 will move upwardly at an angle of about 10 degrees into position with a portion of surface 130 in front of the front face of the bolt 18, thus blocking forward movement of the bolt 18. This is the fully open position of the bolt 18, with the bolt 18 having been fully withdrawn or moved to the rear. Correspondingly, when the trigger 34 has been depressed at its lower end, the lug 42 will move downwardly, carrying the rear end of the front sear 28 downwardly, thus releasing the bolt 18 to move forward.

The barrel locking nut 30 is threadedly received in the outer end of the receiver 12, with the outer end of the barrel 14 being received in a central bore in the locking nut 30. An enlarged flange portion 100 of the barrel 14 is crimped into a recess in the locking nut 30 to provide a one-piece assembly which includes the barrel locking nut 30, the barrel 14 and the muzzle brake/heat sink 102 which is formed at the outer end of the barrel locking nut 30. The muzzle brake/heat sink 102 includes a cylindrical compensator portion 104 which extends outwardly beyond the barrel 14, the cylinder 104 having a series of parallel slots 106 located at intervals transversely across the top surface to assist in deflecting muzzle gases upwardly during firing. In one embodiment, the slots 106 are located at equal intervals along the length of the cylinder 104, extending across the top of the cylinder 104 approximately one-fourth of the circumference of the cylinder 104, and located so as to extend an equal distance on either side of a vertical plane through the longitudinal axis of the cylinder 104, and with each slot 106 extending approximately $\frac{1}{4}$ inch along the length of the cylinder. It has been found that these slots 106, located across the top of the cylinder 104, are of great benefit in reducing barrel jump during firing. A series of fins 108 are located around the circumference of the inner end of the muzzle brake 102 to assist in heat dissipation. Also, the outer end 110 of the cylinder 104 is closed down by crimping, a feature which also assists the muzzle brake 102.

As shown in FIGS. 1–4, the firearm 10 includes a front 45 and rear 46 handgrip, with each handgrip being capable of carrying a magazine. The front handgrip 45 includes a hollow frame member 47, of rectangular cross-section, which is detachably secured to the receiver 12 by means of a ring member 112 to which the frame 47 is attached by welding or the like. The ring member 112 fits snugly over the outer end of the receiver 12 in sliding engagement and is retained longitudinally between a flange on the inner end of the muzzle brake 102 and the front sight 15. As shown in FIG. 2, a retaining button 114 and spring 116, of conventional construction, are mounted in the upper surface of the barrel locking nut 30 for engagement with any of a series of holes 118 located around the forward circumference of the ring 112. The button 114 engages the portion of the ring 112 adjacent each hole 118 as the ring is rotated by applying pressure on the front handgrip 45, allowing the handgrip 45 to be locked in various positions relative to the receiver 12. Thus it has been found that, by locating the holes 118 so that the front handgrip 45 can be locked into a position 90 degrees either right or left of the vertical, an essentially ambidextrous weapon is provided which is well suited for use by either right or left handed operators.

In FIG. 5 there is shown an embodiment in which the front handgrip 45 has been removed by removing the locking barrel nut 30, withdrawing the ring member 112 with handgrip 45 attached, and reattaching the locking barrel nut 30. In this manner there is provided a machine pistol having full capability for automatic or semi-automatic fire.

A shaped grip pad 48, of plastic or other durable material, is secured to the rear of frame member 47 by means such as a screw or bolt 49. At the lower end of the front handgrip 45 there is provided a U-shaped magazine catch 50 which fits into a recess 52 in the grip pad 48, being pivotally secured thereto by a pin 54 mounted within the grip pad 48, and with the catch 50 being received into the interior of frame member 47 through opening 56 for interaction with a magazine 51 carried in member 47. A spring 58 mounted horizontally within the grip pad 48 biases the upper end of the inner portion of the catch 50 so that inner projection 60 of the catch 50 will engage the magazine 51 inserted into the handgrip 45 with the magazine 51 being retained by the force of the spring 58 until released by pressing on the lower outer end of the catch 50, an action which causes the upper end of the inner portion of the catch 50 to compress the spring 58 as the catch 50 rotates about pin 54.

In a similar manner, the rear handgrip 46 includes hollow frame member 62 secured to the housing 12, and with a pair of grip pad members 64 secured by screws 65 to respective vertical flange portions 66 which are welded or otherwise secured to the rear of the frame 62. The flanges 66 define between them a channel 67 which receives an inverted L-shaped elongated bar member 68 which functions as a rear sear/trigger combination. In FIGS. 2–4, one of the flanges 66 and the adjacent grip pad 64 nearest the viewer have been removed for clarity of description. A trigger guard 69 for the front trigger 34 is mounted on the frame member 62 and the receiver 12.

The upper horizontal arm 70 of sear/trigger member 68 fits within the receiver 12 through opening 72 and is movable pivotally within the receiver 12 about the intersection of arm 70 with vertical arm 74 of member 68. A horizontal lip member 76 is located on member 68 just below arm 70 to provide a notch between lip 76 and arm 70, such a configuration contributing to the stability of the mounting of the member 68 relative to the receiver 12. The arm 70 is bifurcated at 146, as shown in FIGS. 2–4 and 10, to provide a pair of parallel arms 70*a* and 70*b*. At the extreme outer end of each arm 70*a*, 70*b* there is provided a raised lug portion 78 which, in one position of the bolt 18, engages notched portions 79 of the bolt 18 to prevent forward movement of the bolt 18.

The lower end of the vertical arm 74 of sear/trigger 68 is provided with an inner projection 80 having a vertical inner face 81 with a recess 82 therein for receiving a horizontally mounted spring 84. Mounted within the channel 67 below the sear/trigger 68 is a U-shaped magazine catch 86 similar to the catch 50 mounted on the front handgrip 45. Catch 86 is pivotally secured by a pin 88 which extends between the flange members 66. As shown in FIG. 1, both magazine catches 50, 86 are mounted in the vertical plane through the longitudinal axis of the firearm 10 so as to facilitate either left or right handed operation.

An opening 90 in the lower end of the frame 62 allows the inner portion of the catch 86 to be received into the interior of the frame 62 for interaction with the magazine 92 carried by member 62. The spring 84 biases the upper end of the inner portion of the catch 86 with the result that inner projection 94 of the catch 86 will engage the magazine 92, retaining the magazine 92 until released by pressing on the lower outer end of the catch 86, an action which compresses the spring 84. It should be noted that sufficient clearance is provided between the upper end of the inner portion of the catch 86 and the inner face 81 of the sear/trigger 68 to allow the sear/trigger 68 to pivot sufficiently upon the application of pressure on the lower end of vertical arm 74 of the sear/trigger 68 so that the lugs 78 on the upper arm 70 of the sear/trigger 68 will move downwardly, out of the path of the bolt 18. Such action occurs during the firing operation as described hereinafter and also results in additional force being applied against the spring 84 and the inner projection 94 of the catch 86, thus reinforcing the action of the catch 86 in preventing the magazine 92 from becoming disconnected from the handgrip 46 during the firing operation. The magazine catch 86 and spring 84 mounting also assist in maintaining the sear/trigger 68 in position. Thus in the absence of pressure being exerted on the lower end of the sear/trigger 68, the lugs 78 will remain in the path of the bolt 18 to effectively stop the bolt 18 at the point where the lugs 78 engage the notched portions 79 of the bolt 18.

The upper end of vertical arm 74 of sear/trigger 68 is curved inwardly so as to lie within the framework provided by the surrounding flanges 66. This upper portion of arm 74 which lies within the contour of the flanges 66 and grip pads 64 extends sufficiently far down the handgrip so that the hand of the operator can hold the weapon comfortably at the upper end of grip 46 with the web of the hand and the thumb and index finger without depressing the sear/trigger 68. Thus upon encircling the rear handgrip 46 with the hand during operation of the firearm 10, the hand will be incapable of depressing the rear sear/trigger 68 inwardly except at the lower end thereof.

As shown in FIGS. 2–4 and also FIGS. 8 and 11, an elongated, planar ejector member 140 is positioned between the ribs 33, 35 of the bolt 18, being mounted against plate 24 at the rear and with a forward finger portion 142 which rests on the upper end of the frame member 62. The ejector forward portion 142 extends forward sufficiently to function as a means of ejecting the spent cartridge case during the firing cycle, as shown in FIG. 8. In addition, the finger portion 142 rests directly over the magazine 92, as shown in FIGS. 1–3 and 11 and thus acts as a bullet guide as the cartridges move upwardly from the magazine 92 for loading into the barrel 14.

With reference to FIG. 4, this is the dual position of Fire/Safe known as the closed bolt position which is obtained either during hot use of the weapon while firing or, alternatively, during safe storage. From this position the operator charges the bolt 18 by moving the bolt handle 19 to the rear until it locks, an indication that the main sear 28 has engaged with the front of the bolt 18. The two recoil springs 21 are now compressed allowing the triggers 34, 68 to control the potential energy of the bolt. The weapon is now charged and ready to fire. The disposition of the weapon components in this position may occur either manually or automatically from gas blowback after firing.

With reference to FIG. 2, this is the open bolt position. From this position the operator has a choice of either fully automatic or semiautomatic fire by a means which is unique to the present firearm.

If the operator wishes to operate the weapon in the semiautomatic mode, then the following procedure must be followed. The operator will grasp the rear handgrip 46 in such a way that only the web of the hand and the pincer force of the thumb and index finger hold the weapon. From this position, the index finger squeezes the main/front trigger 34 without allowing the palm of the hand to engage the rear trigger 68. The bolt 18 will be disengaged from the main/front sear 28 and will travel forward until the notched portions 79 in the rear of the bolt engage the rear sear lugs 78. The weapon now rests in the position shown in FIG. 3.

Semiautomatic operation requires two steps. In the second step, the main/front trigger 34 should be released and the rear trigger 68 then depressed. This allows the bolt 18 to travel freely forward to the position shown in FIG. 4.

If the operator wishes to operate the weapon in fully automatic fire, then the following procedure should be followed. Starting with the position of FIG. 2, both triggers 34, 68 should be squeezed, with the sequence not being of importance. This procedure allows the bolt to travel freely forward to the position shown in FIG. 4.

During movement of the firearm components from the position shown in either FIG. 2 or FIG. 3 to the position shown in FIG. 4, the potential energy of the recoil springs 21 causes the bolt to move forward as released from one of the triggers. As the bolt 18 passes over the magazine containing live cartridges, the forward end of one of the ribs 33, 35 located just below the fixed firing pin 29 causes a cartridge to slide from the magazine. This cartridge is guided into the chamber by a fixed ramp and the unique bullet guide 140 which is a dual purpose ejector. As the live cartridge enters the chamber of the barrel 14, the extractor 25 locks over the rim of the casing. Finally, as the cartridge seats in the chamber, the fixed firing pin 29 contacts the primer of the live cartridge and ignites the gun powder. The expanding gases force the spent case backward, which in turn forces the bolt 18 backward. As the spent case clears the chamber, the bottom portion of the case head contacts the ejector 140. Thus the spent case is released upward and out of the ejection port 31.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by Letters Patent is:

1. A firearm which can fire in either a semiautomatic or full automatic mode, comprising:

a receiver;

a bolt slideable in forward and rearward directions within said receiver, said bolt having a firing pin mounted thereon;

a barrel mounted within said receiver;

means for chambering a cartridge in said barrel;

means for ejecting a cartridge from said receiver;

a trigger assembly including a front trigger that can be pulled rearwardly, a front sear engaged by said front trigger, spring means for urging a portion of the front sear upwardly so that said front sear assumes a position in the path of and forward of said bolt when said bolt is in the fully open position, said spring means being actuated by movement of said front trigger rearwardly to depress said front sear out of the path of said bolt, and a rear trigger having a rear sear portion which blocks forward movement of said bolt position forward of the fully open position, said rear sear portion being actuated by forward movement of the lower portion of said rear trigger to release said bolt to move to the fully closed position.

2. The firearm of claim 1 wherein said barrel is mounted in sliding telescoping relation within the forward portion of said bolt.

3. The firearm of claim 1 wherein said rear trigger is in the form of an inverted L-shaped member having an upper generally horizontal arm and a lower generally vertical arm, said upper arm having a lug portion which forms a portion of the rear sear for engagement with said bolt in one position of said bolt.

4. The firearm of claim 1 wherein said ejecting means includes an ejector mounted within said receiver so as to be in position to assist in ejecting spent cartridges from said receiver while also acting as a bullet guide for cartridges being brought into position for chambering within said barrel, and further wherein a magazine is mounted in operative engagement with the means for chambering a cartridge in said barrel, said ejector having a forward portion which is positioned directly above and centered on a common vertical plane with said magazine.

5. The firearm of claim 1 wherein a barrel locking nut is mounted on the outer end of said receiver, said locking nut having a muzzle brake portion at the outer end thereof, said muzzle brake portion having a cylindrical member with a plurality of parallel slots located transversely across the top portion of said cylindrical member, said slots being positioned so as to extend an equal distance on either side of a vertical plane through the longitudinal axis of said receiver.

6. The firearm of claim 1 wherein forward and rear handgrips are mounted on said receiver, each of said handgrips having means for holding a magazine, the magazine held by said rear handgrip being in operative engagement with the means for chambering a cartridge in said barrel.

7. The firearm of claim 6 wherein the magazine holding means of at least one handgrip includes releasable catch means for maintaining a magazine within said handgrip.

8. The firearm of claim 7 wherein said releasable catch means is mounted on said rear handgrip, said catch means being in operative engagement with the rear trigger whereby forward movement of the lower portion of said rear trigger applies additional force to said catch means to maintain a magazine within said rear handgrip.

9. The firearm of claim 6, further including means for enabling rotation of said forward handgrip in a plane perpendicular to the longitudinal axis of said receiver.

10. The firearm of claim 9 wherein said bolt is provided with a bolt charging handle mounted vertically and centered on a common vertical plane with the longitudinal axis of said bolt, and wherein the magazine holding means of at least one handgrip includes releasable catch means for maintaining a magazine within said handgrip, said catch means being centered on a common vertical plane with the longitudinal axis of said receiver, and further wherein said enabling means includes means for enabling rotation of said forward handgrip 90 degrees to either side of a vertical position.

* * * * *